US006734780B2

(12) United States Patent
Endo et al.

(10) Patent No.: US 6,734,780 B2
(45) Date of Patent: May 11, 2004

(54) FUSE ASSEMBLY

(75) Inventors: Takayoshi Endo, Shizuoka (JP); Hiroki Kondo, Shizuoka (JP); Goro Nakamura, Shizuoka (JP); Takahiro Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 5 days.

(21) Appl. No.: 09/799,688

(22) Filed: Mar. 7, 2001

(65) Prior Publication Data

US 2001/0026208 A1 Oct. 4, 2001

(30) Foreign Application Priority Data

Mar. 31, 2000 (JP) ..... 2000-099747

(51) Int. Cl.[7] ..... H01H 85/153; H01H 85/044

(52) U.S. Cl. ..... 337/262; 337/231; 337/234; 337/252; 337/260; 439/622; 439/890

(58) Field of Search ..... 337/186, 187, 337/228, 231, 234, 251, 252, 260, 262, 290, 295; 439/621, 622, 830, 890, 893

(56) References Cited

U.S. PATENT DOCUMENTS

| | | | | | |
|---|---|---|---|---|---|
| 4,023,265 | A | * | 5/1977 | Aryamane | 29/623 |
| 4,040,175 | A | * | 8/1977 | Williamson et al. | 29/623 |
| 4,099,320 | A | * | 7/1978 | Schmidt, Jr. et al. | 29/623 |
| 4,580,124 | A | | 4/1986 | Borzoni | |
| 4,635,023 | A | * | 1/1987 | Oh | 337/163 |
| 4,831,353 | A | * | 5/1989 | Gaia et al. | 337/255 |
| 4,997,393 | A | * | 3/1991 | Armando | 439/620 |
| 5,293,147 | A | * | 3/1994 | Oh et al. | 337/227 |
| 5,629,664 | A | * | 5/1997 | Muramatsu et al. | 337/261 |
| 5,854,583 | A | * | 12/1998 | Falchetti | 337/290 |
| 5,977,859 | A | * | 11/1999 | Kawamura et al. | 337/295 |
| 6,359,543 | B2 | * | 3/2002 | Endo et al. | 337/198 |

FOREIGN PATENT DOCUMENTS

| | | | | | |
|---|---|---|---|---|---|
| DE | 81 11 548 | U1 | | 3/1983 | |
| EP | 0 248 493 | A2 | | 12/1987 | |
| GB | 2090081 | A | * | 6/1982 | H01H/85/54 |
| JP | 6-44446 | | | 6/1994 | |
| JP | 10199395 | A | * | 7/1998 | H01H/85/56 |
| JP | 10199396 | A | * | 7/1998 | H01H/85/56 |
| JP | 11273544 | A | * | 10/1999 | H01H/85/12 |

OTHER PUBLICATIONS

Office Action from German Patent and Trademark Office in parallel German Application No. 101 15 573.5–32 dated Mar. 18, 2003.

* cited by examiner

*Primary Examiner*—Anatoly Vortman
(74) *Attorney, Agent, or Firm*—Armstrong, Kratz, Quintos, Hanson & Brooks, LLP

(57) ABSTRACT

A fuse assembly 1 including a pair of terminals 2 which are arranged in parallel to each other, a housing 4 having a cavity 20 for containing one end portions 3*a* of the terminals, and a fusible body 5 interconnecting the terminals 2. The fusible body 5 consists of a pair of supporting portions 39 connected to end faces 8 of the terminals 2, and a connecting portion 40 interconnecting the supporting portions 39. The fuse assembly 1 further includes anchoring parts 30 for fixing the fusible body 5 to the housing 4 and second anchoring parts 31 for fixing the terminals 2 to the housing 4. The anchoring parts 30 include through holes 45 formed in the supporting portions 39, and projections 46 projected from an inner face 17 of the housing 4 and adapted to be engaged in the through holes 45. Thus, conduction of heat generated in the fusible body 5 to electrical equipments connected to the terminals can be restrained.

2 Claims, 3 Drawing Sheets

FUSE ASSEMBLY

BACKGROUND OF THE INVENTION

1. Field of the Invention

The present invention relates to a fuse assembly.

2. Description of the Related Art

In a vehicle as a moving body, there are various transmission lines for transmitting electric power, signals and so on, such as busbars contained in an electricity connection box such as a junction block, relay box, fuse block, terminals of electrical connector, etc.

In the above described transmission lines, there have been used fuse blocks provided with a number of detachable fuses for protecting electric circuits of various types of electric equipments from breakdown. Since the fuse block may include relays and busbars, the fuse block is also called as a relay box or a junction block, or generally called as an electricity connection box. In this specification, the fuse block, relay box, junction box will be hereinafter called as the connection box in general.

Conventionally, a fuse assembly 51 as shown in FIG. 4 has been used as the fuse to be used in the connection box. As shown in FIGS. 4 and 5, the fuse assembly 51 consists of a pair of terminals 52 arranged in parallel to each other, a housing 54 which contains one end portions 53 of these terminals 52, and a fusible body 55 integrally formed with the terminals 52 and bridging the terminals 52.

Each of the terminals 52 is a blade-like member as shown in FIG. 5 and formed of electro-conductive metal. A plurality of through holes 56 are formed in the terminals 52 so as to extend through a matrix composing the terminals 52. The terminals 52 illustrated in FIGS. 4 and 5 are respectively provided with two through holes 56 arranged in a longitudinal direction. The two through holes 56 are provided both in middle parts 57 of the respective terminals 52 and at positions adjacent to the one end portion 53 thereof.

Respective other end portions 58 of the terminals 52 are electrically connected to receiving terminals or so in the aforesaid connection box, when the fuse assembly 51 is contained in the connection box. One of the receiving terminals is supplied with power from an electric source or so, while various loads are electrically connected to the other of the receiving terminals.

Accordingly, one of the terminals 52 is supplied with the power through the receiving terminal, while, to the other of the terminals 52, are connected the various loads. The one end portions 53 of the terminals 52 are contained in the housing 54 in a state where their inner faces 61 are opposed to each other.

The housing 54 is formed in a box-like shape and molded of insulating synthetic resin. The housing 54 defines therein a cavity for containing the one end portions 53 of the terminals 52. The housing 54 is provided with projections (not shown) which are adapted to be respectively engaged in the aforesaid through holes 56. When the projections are brought into engagement with the through holes 56, the terminals 52 are fixed to the housing 54.

The fusible body 55 interconnects the terminals 52, as shown in FIG. 5. Both ends of the fusible body 55 are respectively connected to the inner faces 61 of the terminals 52 located at the middle parts 57 of the terminals 52. The fusible body 55 has a fuse portion 62 which is adapted to be fused when amperage of the electric power supplied through one of the terminals 52 has exceeded a threshold value. The fuse portion 62 is formed by designing a middle part of the fusible body 55 to be smaller in its sectional area.

The fuse assembly 51 having the above described structure and installed in the connection box is adapted to stop the supply of the electric power to the aforesaid loads, as the fuse portion 62 is fused when the amperage of the power supplied to one of the terminals 52 via the aforesaid one of the receiving terminals has exceeded the threshold value.

In the conventional fuse assembly 51 as illustrated in FIG. 4, the fusible body 55 is connected to the middle parts 57 of the terminals 52. For this reason, when the fusible body 55 is heated by an overcurrent, the heat generated in the fusible body 55 is easily conducted to the other end portions 58 of the terminals 52.

In other words, in the conventional fuse assembly 51, the heat generated in the fusible body 55 has been likely to be conducted to the receiving terminals in the connection box as an external apparatus which are connected to the terminals 52. When the heat has been conducted to the receiving terminals, a casing of the connection box formed of insulating synthetic resin or the like may be undesirably deformed.

Moreover, because in the conventional fuse assembly 51, the through holes 56 are formed in the terminals 52, the fusible body 55, especially the fuse portion 62 is likely to vibrate due to vibrations or a sudden acceleration during driving, etc. of an automobile in which the connection box is installed.

Particularly, in case where the fusible body 55 is heated, there has been a fear that the fusible body 55 may be broken as a result of fatigue failure which has occurred at jointed parts with the terminals 52 due to the above described vibrations or so. In this case, the fusible body 55 will be detached from the terminals 52. As described, in the conventional fuse assembly 51, even though the amperage of the power supplied to one of the terminals 52 has not exceeded the threshold value, the electrical connection between the pair of the terminals 52 may sometimes be interrupted.

In view of the above, an object of the present invention is to provide a fuse assembly in which the heat conducted to the equipments connected to the terminals can be restrained, and which is free from interruption of the electrical connection between the terminals in case where the amperage is not above the value at which the fusible body is fused.

SUMMARY OF THE INVENTION

In order to attain the above described object, there is provided, according to the present invention, a fuse assembly comprising a pair of terminals which are arranged in parallel to each other, a housing having a cavity for containing one end portions of the terminals, and a fusible body interconnecting the terminals, wherein the fuse assembly is provided with anchoring parts for mounting the fusible body to the housing.

According to another aspect of the invention, each of the anchoring parts includes a through hole passing through the fusible body, and a projection projected from an inner wall of the housing defining the cavity, the projection being adapted to be engaged in the through hole.

According to a further aspect of the invention, the fusible body includes supporting portions which are respectively connected to end faces positioned at the one end portions of the terminals, and the through holes being formed in the supporting portions.

According to a still further aspect of the invention, the fuse assembly further includes second anchoring parts for respectively mounting the terminals to the housing, and the through holes are provided at ends of the supporting portions remote from the end faces of the terminals.

According to the first aspect of the invention, because the fusible body is fixed to the housing by means of the anchoring parts, the heat generated in the fusible body is conducted to the housing via the anchoring parts, and the fusible body will not easily vibrate when subjected to vibrations or sudden acceleration of an automobile.

According to the second aspect of the invention, because the anchoring parts include the through holes passing through the fusible body and the projections to be engaged in the through holes, the heat generated in the fusible body is conducted to the housing by way of the through holes and the projections, and the fusible body can be more reliably fixed to the housing.

According to the third aspect of the invention, because the through holes are provided in the supporting portion of the fusible body connected to the end faces of the terminals, the heat generated in the fusible body is easily conducted to the housing before conducted to the equipments connected to the terminals.

According to the third aspect of the invention, because the through holes are provided at the ends of the supporting portions remote from the end faces of the terminals, the heat generated in the fusible body is more easily conducted to the housing before conducted to the equipments connected to the terminals.

DESCRIPTION OF THE PREFERRED EMBODIMENTS

Figure 2:
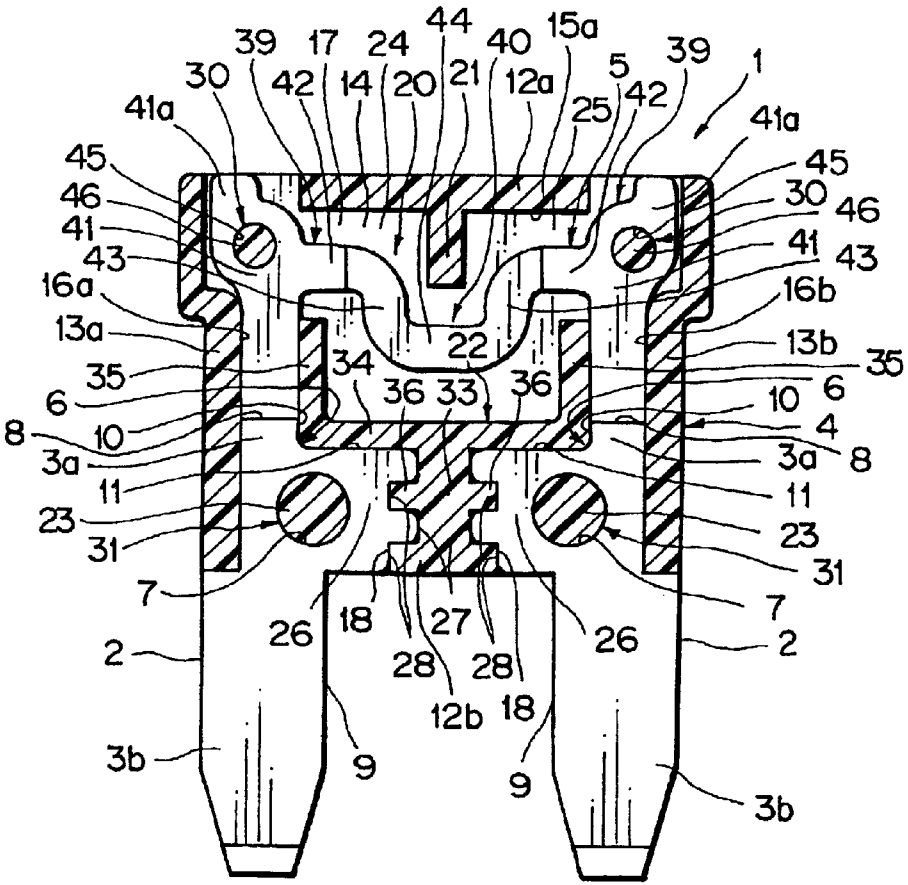
FIG. 2 is a sectional view of the fuse assembly taken along a line II—II of FIG. 1.
Figure 1:
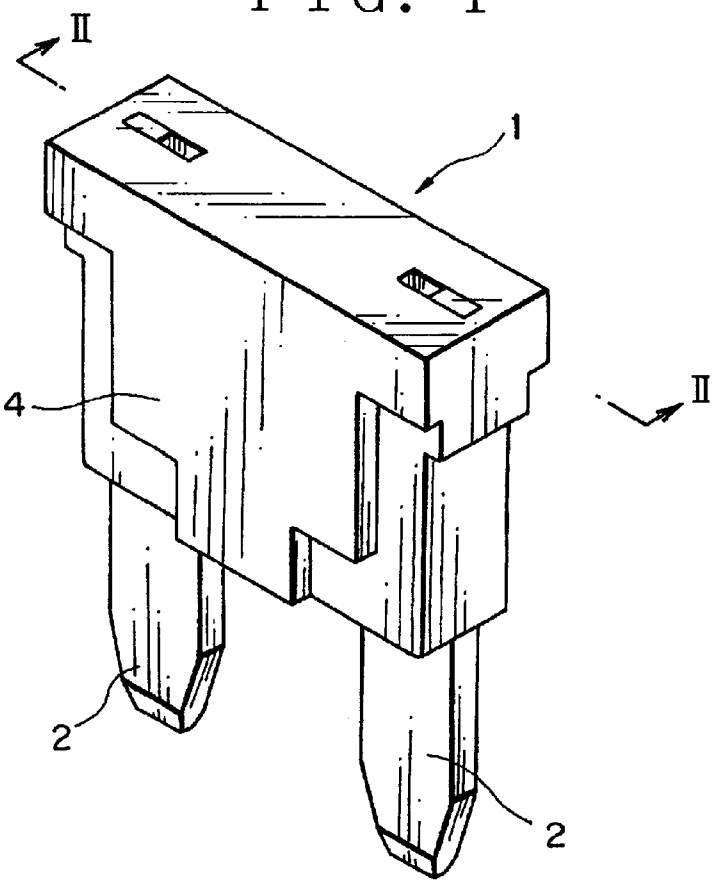
FIG. 1 is a perspective view of a fuse assembly according to one embodiment of the present invention.
Figure 4:
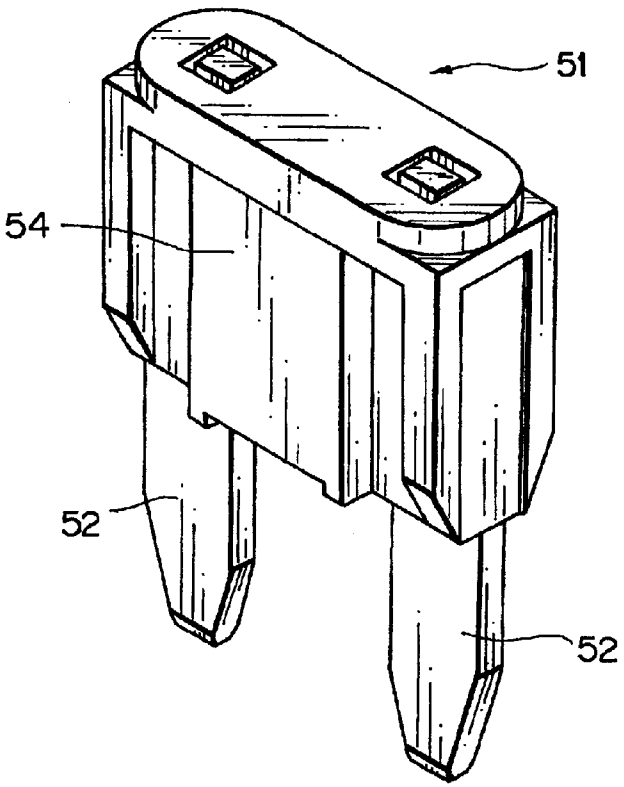
FIG. 4 PRIOR ART
FIG. 4 is a perspective view of a conventional fuse assembly.
Figure 3:
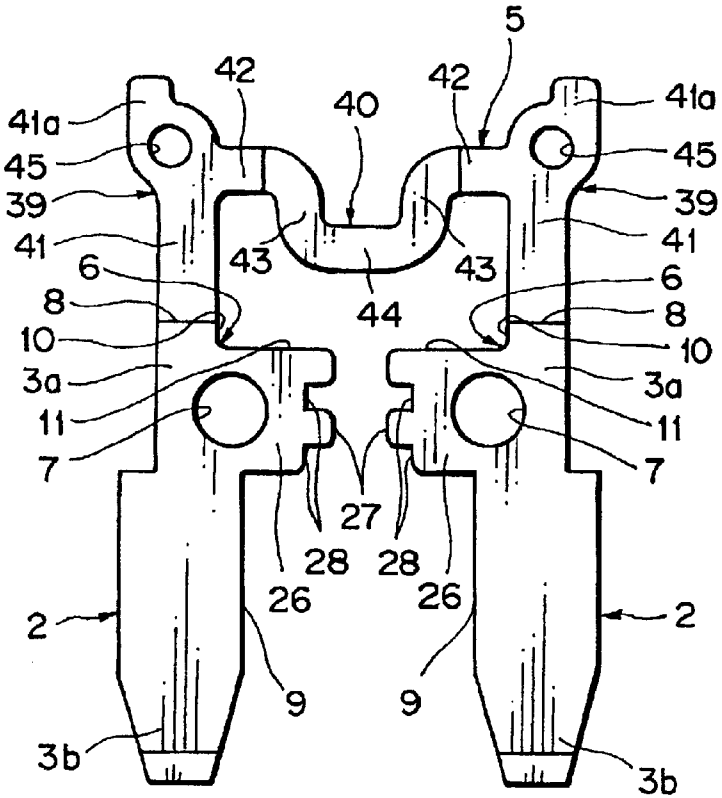
FIG. 3 is a view showing terminals and a fusible body of the fuse assembly of FIG. 1.
Figure 5:
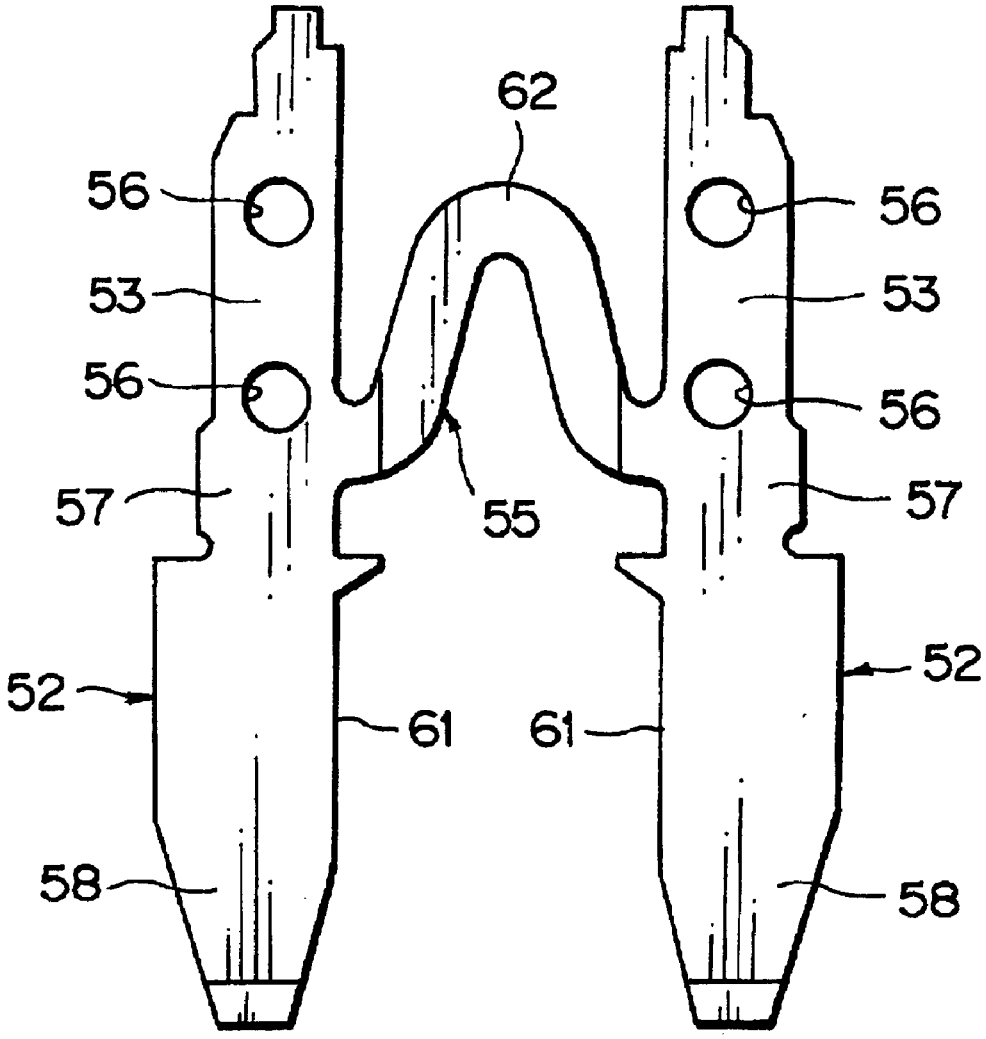
FIG. 5 PRIOR ART
FIG. 5 is a view showing terminals and a fusible body of the conventional fuse assembly of FIG. 4.

Now, a fuse assembly according to one embodiment of the present invention will be described referring to FIGS. 1 to 3. As shown in FIGS. 1 and 2, a fuse assembly 1 consists of a pair of terminals 2 which are juxtaposed in parallel to each other, a housing 4 adapted to contain one end portions 3*a* of the terminals 2, a fusible body 5 interconnecting the terminals 2, first anchoring parts 30, and second anchoring parts 31.

The terminals 2 are formed in a blade-like shape and composed of electro-conductive material. The pair of the terminals 2 are arranged in parallel to each other in such a manner that respective one end portions 3*a* are received in the housing 4 and the other end portions 3*b* are exposed from the housing 4. As clearly shown in FIGS. 2 and 3, the terminals 2 are provided with cut-away parts 6 and inwardly projected portions 26 respectively.

The cut-away parts 6 are formed in the one end portions 3*a* starting from end faces 27 of the inwardly projected portions 26, which will be described later, in a concave manner in a direction in which the pair of the terminals 2 are apart from each other. The cut-away parts 6 are formed in such a manner that a distance between the two terminals 2 is stepwisely made larger than a distance between the inwardly projected portions 26.

Each of the cut-away parts 6 has a flat face 10 extending in a longitudinal direction from an end face 8 positioned in the one end portion 3*a* of the terminal 2 to the middle part, and a stepped face 11 continued from the flat face 10 to the end face 27 of the inwardly projected portion 26.

The flat face 10 is formed flat in a longitudinal direction of the terminal 2. A distance between the flat faces 10 is larger than a distance between inner faces 9 which are positioned in the other end portions 3*b* of the terminals 2. The stepped face 11 is formed in a direction in which the pair of the terminals 2 approach each other, that is, the direction in which the terminals 2 are juxtaposed. In a state where the terminals 2 are fitted to the housing 4, the cut-away parts 6 are contained in the housing 4.

The inwardly projected portions 26 are provided in the one end portions 3*a* of the terminals 2 in the middle parts of the terminals 2 apart from the cut-away parts 6. The inwardly projected portions 26 project from the inner faces 9 in a direction in which the terminals 2 approach each other. The inwardly projected portions 26 have the end faces 27 facing with each other and recesses 28 formed in a concave manner from the end faces 27.

These end faces 27 are formed flat in the longitudinal direction of the terminals 2. The recesses 28 are concaved from the end faces 27 in a direction in which the terminals 2 are apart from each other. In the illustrated embodiment, there are formed the two recesses 28 in each one of the end faces 27, in short, in each one of the terminals 2. When the one end portions 3*a* of the terminals 2 have been received in the housing 4, the inwardly projected portions 26 having the described structure will be contained in the housing 4.

Respective other end portions 3*b* of the terminals 2 are electrically connected to receiving terminals in the aforesaid connection box, when the fuse assembly 1 is contained in the connection box. One of the receiving terminals is supplied with electric power from an electric source or so, while various loads are electrically connected to the other of the receiving terminals. Accordingly, one of the terminals 2 is supplied with the power through the receiving terminal, while, to the other of the terminals 2, is connected the loads.

The housing 4 is in a box-like shape and molded of insulating synthetic resin or the like. As shown in FIG. 2, the housing 4 includes a pair of end walls 12*a*, 12*b*, a pair of side walls 13*a*, 13*b*, and a pair of body walls 14.

The end walls 12*a*, 12*b* are opposed to each other in a direction intersecting the direction in which the terminals 2 are juxtaposed. When the terminals 2 have been received in the housing 4, the end walls 12*a*, 12*b* are parallel to the end faces 8 of the terminals 2 in such a manner that one of the end walls 12*a* is concaved from the end faces 8. The side walls 13*a*, 13*b* are opposed to each other in the direction in which the terminals 2 are juxtaposed. The side walls 13*a*, 13*b* are respectively arranged along the longitudinal direction of the terminals 2.

The body walls 14, 14 extend in the longitudinal direction of the terminals 2, and are opposed to each other in the direction intersecting the direction in which the terminals 2 are juxtaposed. The body walls 14, 14 are respectively connected to both the end walls 12*a*, 12*b* and the side walls 13*a*, 13*b*. It is to be noted that only one of the body walls 14 which is located in a depth of the drawing is shown in FIG. 2.

A cavity 20 enclosed by an inner face 15*a* of the end wall 12*a*, an inner face of the end wall 12*b*, and respective inner faces 16*a,* 16*b* of the side walls 13*a,* 13*b,* and inner faces 17 of the body walls 14 constitutes a room for containing the one end portions 3*a* of the terminals 2.

The end wall 12*b* which is positioned near the middle parts of the terminals 2 is provided with a pair of through holes 18 into which the terminals 2 are adapted to be inserted respectively.

The housing 4 further includes a first partition wall 21 and a second partition wall 22. The first partition wall 21 is provided midway between the two terminals 2 and extends from an inner face 15*a* of the end wall 12*a* toward the end wall 12*b* in the longitudinal direction of the terminals 2 in parallel to the side walls 13*a,* 13*b.*

The cavity 20 defined in the housing 4 is divided into a first room 24 for containing the one end portion 3*a* of one of the terminals 2 and a second room 25 for containing the one end portion 3*a* of the other terminal 2.

The second partition wall 22 consists of a base end wall 33 which is integrally formed with the end wall 12*b,* a lateral wall 34, a pair of vertical walls 35. The base end wall 33 is positioned between the inwardly projected portions 26 of the terminals 2, and extends from an edge of the through holes 18 of the end wall 12*b* toward the inner face 15*a* of the end wall 12*a* in the longitudinal direction of the terminals 2. The base end wall 33 is so designed as to cover the end faces 27 of the terminals 2, when the one end portions 3*a* have been received in the cavity 20. The base end wall 33 is provided with a plurality of projections 36 corresponding to the aforesaid recesses 28 of the terminals 2.

The lateral wall 34 is connected to an end of the base end wall 33 remote from the end wall 12*b,* and extends in the direction in which the two terminals are juxtaposed. The lateral wall 34 is located along the aforesaid stepped faces 11 of the terminals 2, and adapted to cover the stepped faces 11 when the one end portions 3*a* have been received in the cavity 20.

The vertical walls 35 are connected to both ends of the lateral wall 34 which are respectively opposed to the terminals 2. The vertical walls 35 are provided between the inner faces 16*a,* 16*b* of the side walls 13*a,* 13*b* and the first partition wall 21 respectively, and arranged in parallel to each other in the direction in which the terminals 2 are juxtaposed. The vertical walls 35 are located along the flat faces 10 of the cutaway parts 6 of the terminals 2, and adapted to cover the flat faces 10 when the one end portions 3*a* have been received in the cavity 20.

The two terminals 2 are interconnected by means of the above mentioned fusible body 5. The fusible body 5 is a linear member having a rectangular shape in cross section. The fusible body 5 is so dimensioned in its width and thickness, especially at a connecting portion 40 which will be described below, that it may be fused when the electric power has exceeded the threshold amperage.

The fusible body 5 interconnects the end faces 8 of the terminals 2. In the illustrated embodiment, the fusible body 5 and the two terminals 2 are integrally formed by rolling, machining, or stamping, etc. The fusible body 5 includes a pair of supporting portions 39 and the connecting portion 40 as shown in FIGS. 2 and 3.

Each of the supporting portions 39 has a first extended part 41 and a second extended part 42. The first extended parts 41 extend from the end faces 8 of the terminals 2 toward the end wall 12*a* in a direction away from the terminals 2. The first extended parts 41 extend along the side walls 13*a,* 13*b* and the vertical walls 35, and are respectively received between the inner faces 16*a,* 16*b* of the side walls 13*a,* 13*b* and the vertical walls 35.

The second extended parts 42 extend from respective ends 41*a* of the first extended parts 41 remote from the end faces 8 so as to approach each other. The second extended parts 42 are positioned between the inner face 15*a* of the end wall 12*a* and distal ends of the vertical walls 35, and extend along the inner face 15*a* and the lateral wall 34.

The connecting portion 40 includes a pair of third extended parts 43, and a fourth extended part 44. The third extended parts 43 extend from respective ends of the second extended parts 42 so as to approach each other in a crooked manner.

The third extended parts 43 are interconnected by means of the fourth extended part 44. The fourth extended part 44 is provided between the partition wall 21 and the lateral wall 34, and extends along the inner face 15*a* of the end wall 12*a,* the lateral wall 34, and the end wall 12*b.*

As described above, the fusible body 5 consists of the first to fourth extended parts 41, 42, 43, 44, and is formed in the crooked manner between a connected point with respect to one of the terminals 2 and a connected point with respect to the other of the terminals 2.

The first anchoring parts 30 include through holes 45 formed in the fusible body 5 and projections 46 provided on the body walls 14 respectively. The through holes 45 are formed in a round shape and provided-at the ends 41*a* of the first extended parts 41 of the supporting portion 39 of the fusible body 5 so as to pass therethrough.

The projections 46 are projected from the inner face 17 of at least one of the body walls 14 into the cavity 20 in a direction in which the two body walls 14 approach each other.

The projections 46 are adapted to be engaged in the through holes 45. In other words, the fusible body 5 and the housing 4 are fixed to each other by engaging the projections 46 in the through holes 45 in the anchoring parts 30.

The second anchoring parts 31 include mounting holes 7 formed in the terminals 2 and projections 23 for positioning the terminals. The mounting holes 7 are respectively provided in the one end portions 3*a* of the terminals 2 at positions approaching the center from the cutaway parts 6.

The terminal positioning projections 23 are projected from the inner face 17 of at least one of the body walls 14 in a direction in which the two body walls 14 approach each other. The terminal positioning projections 23 are respectively provided close to the side walls 13*a,* 13*b* and close to the end wall 12*b.*

The terminal positioning projections 23 are adapted to be engaged in the mounting holes 7. In other words, the two terminals 2 and the housing 4 are fixed to each other, by respectively engaging the positioning projections 23 in the mounting holes 7.

With the above described structure, the one end portions 3*a* of the terminals 2 are contained in the cavity 20, in a state where the terminals 2 are located inside of the side walls 13*a*, 13*b,* while the positioning projections 23 of the housing 4 are engaged in the mounting holes 7 and the projections 46 are engaged in the through holes 45. On this occasion, the terminals 2 are disposed in the through holes 18 of the end wall 12*b.*

The fuse assembly 1 having the above described structure is installed in the aforesaid connection box or the like. When the amperage of the electric power supplied to one of the terminals via one of the receiving terminals has exceeded the threshold value, the connecting portion 40 of the fusible body 5 will be fused, thereby stopping the supply of the electric power to the loads.

In the fuse assembly 1 of the present embodiment, the housing 4 and the fusible body 5 are fixed to each other by means of the anchoring parts 30 consisting of the through holes 45 extending through the first extended parts 41 of the fusible body 5 and the projections 46 projected from the inner face 17 of the housing 4.

Accordingly, heat generated in the fusible body 5 by the electric power fed from one of the terminals 2 is conducted to the housing 4 by way of the inner face of the through holes 45 and the projections 46. Therefore, conduction of the heat generated in the fusible body 5 to the electrical equipments connected to the other end portions 3*b* of the terminals 2 will be restrained.

In addition, because the through holes 45 are provided at the ends 41*a* of the first extended parts 41, the heat generated in the fusible body 5 is likely to be conducted to the housing 4 by way of the anchoring parts 30, before it is conducted to those equipments connected to the terminals 2. Therefore, the conduction of the heat generated in the fusible body 5 to the equipments connected to the other end portions 3*b* of the terminals 2 can be more reliably restrained.

Further, because the fusible body 5 is mounted to the housing 4 by means of the first anchoring parts 30, the fusible body 5 may be unlikely to vibrate with respect to the terminals 2, when the connection box containing the fuse assembly 1 is subjected to vibrations or sudden acceleration, during driving, from the automobile or the like in which the connection box is installed. Accordingly, fatigue failure or the like of the fusible body 5 due to the vibrations or so may be avoided, and thus, an interruption of the electrical connection between the pair of the terminals 2 when the amperage is not above the melting point of the fusible body 5 can be reliably prevented.

Furthermore, because the housing 4 and the pair of the terminals 2 are fixed to each other by means of the second anchoring parts 31, the terminals 2 themselves are maintained in the fixed state with respect to the housing 4, even though they are subjected to the vibrations or the sudden acceleration from the automobile during driving. Accordingly, the fatigue failure or the like of the fusible body 5 due to the vibrations or so may be avoided, and thus, an interruption of the electrical connection between the pair of the terminals 2 when the amperage is not above the melting point of the fusible body 5 can be more reliably prevented.

Although the present invention has been fully described by way of examples with reference to the accompanying drawings, it is to be noted that various changes and modifications will be made within a scope of the present invention.

What is claimed is:

1. A fuse assembly comprising: a pair of terminals which are arranged in parallel to each other; a housing having a cavity for containing one end portions of said terminals; a fusible body interconnecting said terminals; and anchoring parts for directly mounting said fusible body to said housing, wherein each of said anchoring parts includes:

a through hole passing through said fusible body; and a projection projected from an inner wall of said housing defining said cavity, said projection being adapted to be engaged in said through hole, and said fusible body includes a connecting portion to be fused and extended parts extending respectively from both ends of said connecting portion for directly mounting said fusible body to said housing, the extended parts being respectively connected to end faces positioned at said one end portions of the terminals, said through holes being formed respectively in said extended parts.

2. The fuse assembly according to claim 1, wherein said fuse assembly further includes second anchoring parts for respectively mounting said terminals to said housing, and said through holes are provided at ends of said extended parts remote from said end faces of said terminals.

* * * * *